US007589673B2

(12) United States Patent
Kuramoto

(10) Patent No.: US 7,589,673 B2
(45) Date of Patent: Sep. 15, 2009

(54) ANTENNA AND MOBILE WIRELESS EQUIPMENT USING THE SAME

(75) Inventor: Mikio Kuramoto, Chiba (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 11/099,572

(22) Filed: Apr. 6, 2005

(65) Prior Publication Data

US 2005/0225484 A1 Oct. 13, 2005

(30) Foreign Application Priority Data

Apr. 13, 2004 (JP) ..... 2004-118067

(51) Int. Cl.
*H01Q 1/38* (2006.01)
*H01Q 1/24* (2006.01)
*H01Q 1/50* (2006.01)

(52) U.S. Cl. ..... 343/700 MS; 343/702; 343/850

(58) Field of Classification Search ..... 343/700 MS, 343/702, 833, 846, 850
See application file for complete search history.

(56) References Cited

U.S. PATENT DOCUMENTS

| | | | | |
|---|---|---|---|---|
| 4,827,266 | A | 5/1989 | Sato et al. | |
| 6,788,257 | B2 * | 9/2004 | Fang et al. | 343/700 MS |
| 6,819,287 | B2 * | 11/2004 | Sullivan et al. | 343/700 MS |
| 6,831,607 | B2 * | 12/2004 | Hebron et al. | 343/700 MS |
| 6,914,570 | B2 * | 7/2005 | Asrani et al. | 343/702 |
| 2001/0048391 | A1 | 12/2001 | Annamaa et al. | |
| 2002/0060644 | A1 | 5/2002 | Talvitie | |
| 2003/0063036 | A1 | 4/2003 | Sato et al. | |
| 2003/0160728 | A1 | 8/2003 | Fukushima et al. | |
| 2003/0174092 | A1 | 9/2003 | Sullivan et al. | |
| 2003/0193438 | A1 | 10/2003 | Yoon | |

FOREIGN PATENT DOCUMENTS

| | | | |
|---|---|---|---|
| CN | 1316797 | A | 10/2001 |
| CN | 1459138 | A | 11/2003 |
| EP | 0444679 | A2 | 9/1991 |
| EP | 1202386 | A2 | 5/2002 |
| EP | 1241733 | A1 | 9/2002 |
| EP | 1396906 | A1 | 3/2004 |
| GB | 2389463 | A | 12/2003 |
| JP | 5-14042 | A | 1/1993 |
| JP | 5-14044 | A | 1/1993 |

(Continued)

*Primary Examiner*—Shih-Chao Chen
(74) *Attorney, Agent, or Firm*—Birch, Stewart, Kolasch & Birch, LLP

(57) ABSTRACT

An antenna apparatus includes a tabular ground conductor, a radiation conductor facing the ground conductor, a short-circuit portion for short-circuiting the ground conductor and the radiation conductor, an opening disposed on the ground conductor where the location is positioned at a distance of d from the short-circuit portion in the in-plane direction of the tabular ground conductor, and a feed portion extending from the radiation conductor and passing through the opening in a noncontact manner regarding the ground conductor. The feed portion is connected to a matching circuit. The distance d between the short-circuit portion and the feed portion is the length such that the antenna is not resonant at a frequency used for communication, and the matching circuit performs adjustments such that the antenna is constrained to resonate in one or more communication frequency bands.

20 Claims, 12 Drawing Sheets

FOREIGN PATENT DOCUMENTS

| | | | |
|---|---|---|---|
| JP | 8139520 | | 5/1996 |
| JP | 9-232854 | A | 9/1997 |
| JP | 9-326628 | A | 12/1997 |
| JP | 2001-274619 | A | 10/2001 |
| JP | 2002-344231 | A | 11/2002 |
| JP | 2002330021 | | 11/2002 |
| JP | 2002-353716 | A | 12/2002 |
| JP | 2003-051712 | | 2/2003 |
| JP | 2003-101332 | | 4/2003 |
| JP | 3094677 | U | 4/2003 |
| WO | WO-02/11236 | A1 | 2/2002 |
| WO | WO-02/095868 | A1 | 11/2002 |
| WO | WO-03/094290 | A1 | 11/2003 |

* cited by examiner

ANTENNA AND MOBILE WIRELESS EQUIPMENT USING THE SAME

This nonprovisional application claims priority under 35 U.S.C. § 119(a) on Patent Application No. 2004-118067 filed in Japan on Apr. 13, 2004, the entire contents of which are hereby incorporated by reference.

BACKGROUND OF THE INVENTION

1. Field of the Invention

The present invention relates to an antenna capable of transmitting or receiving signal waves in not less than two frequency bands and capable of good transmission and reception when used for mobile wireless equipment, regardless of usage form.

2. Background Art

An inverted F antenna is used for mobile phones, for example, as it has a small shape relative to the wavelengths of radio waves and is readily adapted to a wide band. For example, FIG. 15 shows the configuration of a conventional inverted F antenna. As shown in FIG. 15, a conventional inverted F antenna 210 comprises a solid conductor plate 211 disposed on a ground conductor 215, the solid conductor plate 211 having a radiation conductor plate 212 and a connection conductor plate 213 formed via a punching process or a folding process, such that a first conductor strip 212*a* and a second conductor strip 212*b* of the radiation conductor plate 212 and the connection conductor plate 213, respectively, can each resonate with different frequencies. A feed pin 216 is soldered at a predetermined location on the radiation conductor plate 212. The feed pin 216 is connected to an antenna circuit that is not shown in the drawings without contacting the ground conductor 215. The inverted F antenna 210 configured in the above feeds two kinds, namely high and low, of high-frequency currents to the radiation conductor plate 212 via the feed pin 216 thereby causing the first conductor strip 212*a* to resonate with a signal wave in a first resonant frequency band and the second conductor strip 212*b* to resonate with a signal waves in a second resonant frequency band. Thus, the antenna is capable of operation as an antenna for two-band sharing (see Patent Document 1).

Patent Document 1: JP Utility Model Registration No. 3094677

SUMMARY OF THE INVENTION

The characteristics of the antenna of a mobile phone tend to change depending on the conditions of surrounding areas, usage forms, or the like. For example, clamshell type (folding type) mobile phones may perform transmission or reception in either a folded state or an open state, which poses a problem in that it is difficult to obtain good antenna characteristics in various different usage conditions.

It is an object of the present invention to reduce changes in antenna characteristics resulting from circumstances or usage forms, and to obtain good characteristics under any conditions.

In accordance with an antenna of the invention, a feed portion and a short-circuit portion in a tabular antenna are spaced apart from one another by a distance not less than ⅙ of the circumference of the antenna so as not to resonate in a desired frequency band. Further, adjusting means for adjusting the resonant frequency of the antenna is separately provided. In this way, improved reflection characteristics of the antenna can be obtained in not less than two desired frequency bands.

In one aspect of the present invention, there is provided an antenna comprising a ground conductor plate, a radiation conductor plate disposed at a certain distance from the ground conductor plate in a facing manner, a short-circuit portion for connecting the radiation conductor plate and the ground conductor plate, and a feed portion for exciting the radiation conductor plate, wherein the short-circuit portion and the feed portion are spaced apart from one another by a distance not less than ⅙ of the circumference of the radiation conductor plate. The antenna further comprises a matching circuit connected to the feed portion for adjusting the impedance of the antenna. Also, there is provided an antenna comprising a ground conductor plate, a radiation conductor plate disposed at a certain distance from the ground conductor plate in a facing manner, a short-circuit portion for connecting the radiation conductor plate and the ground conductor plate, and a feed portion for exciting the radiation conductor plate, wherein the short-circuit portion and the feed portion are disposed such that the antenna does not resonate with a desired frequency, the antenna further comprising a matching circuit connected to the feed portion for adjusting the impedance of the antenna.

The feed portion and the short-circuit portion are thus disposed such that the resonant frequency determined by the feed portion and the short-circuit portion differs from the resonant frequency of the antenna. Further, the frequency is adjusted through impedance matching via the matching circuit. In this way, stable reflection characteristics can be available in a plurality of frequencies and the influences of circumstances on antenna characteristics can be reduced, for example. In other words, the matching circuit board is used for performing an impedance matching such that the reflection characteristics in a desired frequency can be improved. For example, by performing an impedance matching in one or more frequencies using the matching circuit, antenna characteristics at desired frequencies can be improved.

In our embodiment, a notch cutting is provided in the radiation conductor between the feed portion and the short-circuit portion. Also, by providing the notch cutting in the radiation conductor between the feed portion and the short-circuit portion, a length L is adjusted to be the distance that corresponds with the edge of the notch cutting. By thus providing the notch cutting between the feed portion and the short-circuit portion, the range of frequencies in which matching can be achieved can be increased, so that an antenna band can be widened, especially in low frequencies.

A variable inductor may be provided between the short-circuit portion and a grounded portion of the ground conductor plate. In this way, the adjustment of the resonant frequency becomes possible. In particular, this makes it possible for the antenna to easily take a band in lower frequencies. Also, a parasitic element that is connected to the short-circuit portion may be provided between the feed portion and the short-circuit portion, which makes it possible to increase antenna band. Preferably, the short-circuit portion is disposed in the vicinity of an end of the ground conductor plate. In this way, the antenna becomes less likely to be affected by any change in the condition of the surrounding areas.

In another aspect of the present invention, there is provided mobile wireless equipment comprising a first casing including a display unit and a first circuit board and a second casing including an operation portion, a second circuit board, and any one of the above-described antennas. The first casing and the second casing are disposed so as to face each other, and the first casing is slidable in at least one direction. The antenna is disposed on the end portion towards the aforementioned one direction of the second casing. The short-circuit portion is disposed on the end portion of the board. These features allow the equipment to be less susceptible to the influences of the head of a human body when in use. Also, they reduce the impedance fluctuation of mobile wireless equipment even when the casings slide or the casings open or close.

Since the antenna characteristics are adjusted by impedance matching via a matching circuit rather than by resonance of an antenna per se, the antenna characteristics are less susceptible to the influences of condition changes. Thus, it is not necessary to consider a tradeoff of characteristics among a plurality of usage conditions, so that the antenna characteristics can be improved. Since the antenna characteristics are less susceptible to influences of circumstances, they are not subject to influences of change of resonant frequency resulting from the influences of circumstances, such as when the user's head is near, when the antenna is applied to a folding type mobile phone, for example. Thus, the antenna is advantageous in that it causes less deterioration of antenna characteristics.

BRIEF DESCRIPTION OF THE DRAWINGS

FIG. 1(A) shows a perspective view and FIG. 1(B) shows a side view.

FIG. 3(A) shows a first positional relationship among a ground conductor, a radiation conductor, a feed portion, and a short-circuit portion. FIG. 3(B) shows a second positional relationship.

FIG. 10(A) shows a mode of used when the device is in operation, indicating the state where a first casing and a second casing are disposed in a substantially parallel manner while having a rotation axis therebetween. FIG. 10(B) shows a mode during stand by, indicating the state where the first casing almost covers the second casing. FIG. 10(C) shows a transitional state.

DETAILED DESCRIPTION OF THE INVENTION

Figure 1:
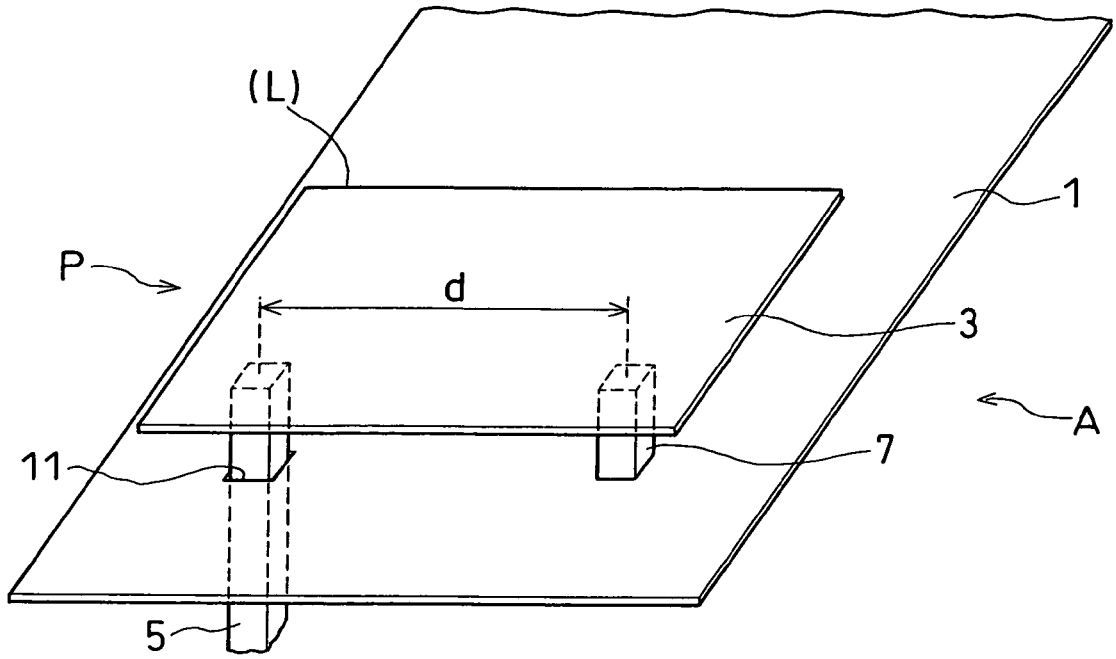
FIG. 1 shows an example of the configuration of an antenna apparatus according to a first embodiment of the present invention.
Figure 1:
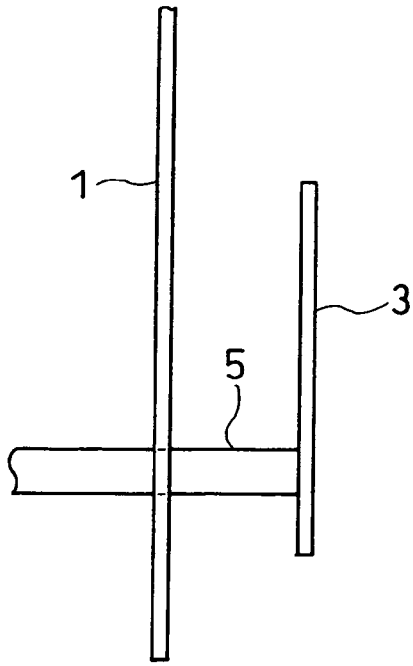

In the following, an antenna apparatus according to a first embodiment of the present invention is described with reference to the drawings. FIG. 1 shows an example of the configuration of the antenna apparatus according to the present embodiment. FIG. 1(A) shows a perspective view and FIG. 1(B) shows a side view. As shown in FIG. 1(A) and FIG. 1(B), an antenna apparatus A according to the present embodiment comprises a tabular ground conductor 1, a radiation conductor 3 disposed in a location facing the ground conductor 1, a short-circuit portion 7 for shod-circuiting the ground conductor 1 and the radiation conductor 3, an opening 11 disposed on the ground conductor 1 where the location is positioned at a distance of d from the short-circuit portion 7 in the in-plane direction of the tabular ground conductor 1, and a feed portion 5 extending from the radiation conductor 3 and passing through the opening 11 so as to not be in contact with the ground conductor 1. These members are disposed in the vicinity of the lower end of a casing. The feed portion 5 is connected to a matching circuit 150 shown in FIG. 2. In the antenna apparatus A according to the present embodiment, the distance d between the short-circuit portion 7 and the feed portion 5 is not less than ⅙ and preferably not less than ¼, of the length of the circumference (the total circumference) of the radiation conductor 3. This enables an increase of the distance d between the short-circuit portion 7 and the feed portion 5, and an adjustment of the resonant frequency of the antenna via the matching circuit, whereby the antenna is made less susceptible to influences of circumstances or influences of changes of usage forms. It is assumed that the antenna apparatus AT according to the present embodiment is disposed in the vicinity of the lower end inside a casing that is not shown in the drawings, in which the antenna apparatus AT is accommodated.

Figure 2:
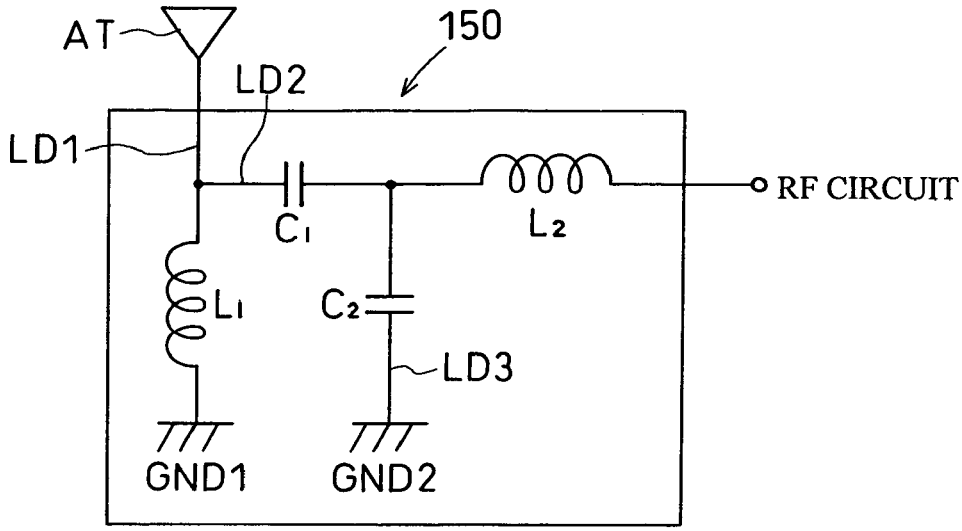
FIG. 2 shows a circuit diagram of an example of a matching circuit that is connected to the antenna apparatus.

FIG. 2 shows a circuit diagram of an example of a matching circuit that is connected to the antenna apparatus AT (denoted by reference A in FIG. 1). As shown in FIG. 2, the matching circuit 150 according to the present embodiment is connected to the antenna AT, and comprises a first coil L1 disposed on a first wiring LD1 connecting the antenna AT to a first ground point GND1, a second wiring LD2 extending from a nodal point between the antenna AT and the first coil L1, a first capacitor C1 and a second coil L2 individually disposed on the second wiring LD2 from the first nodal point side, a third wiring LD3 extending from a nodal point disposed between the first capacitor C1 and the second coil L2 and leading to a second ground point GND2, and a capacitor C2 disposed on the third wiring LD3. An RF circuit that is not shown in the drawings is disposed on the opposite side of the first nodal point on the second wiring LD 2.

In the aforementioned configuration, good reflection characteristics can be obtained in two types of frequency bands using the first combination of the coil L1 and the capacitor C1 on the antenna AT side and the second combination of the coil L2 and the capacitor C2 on the RF circuit side.

Figure 15:
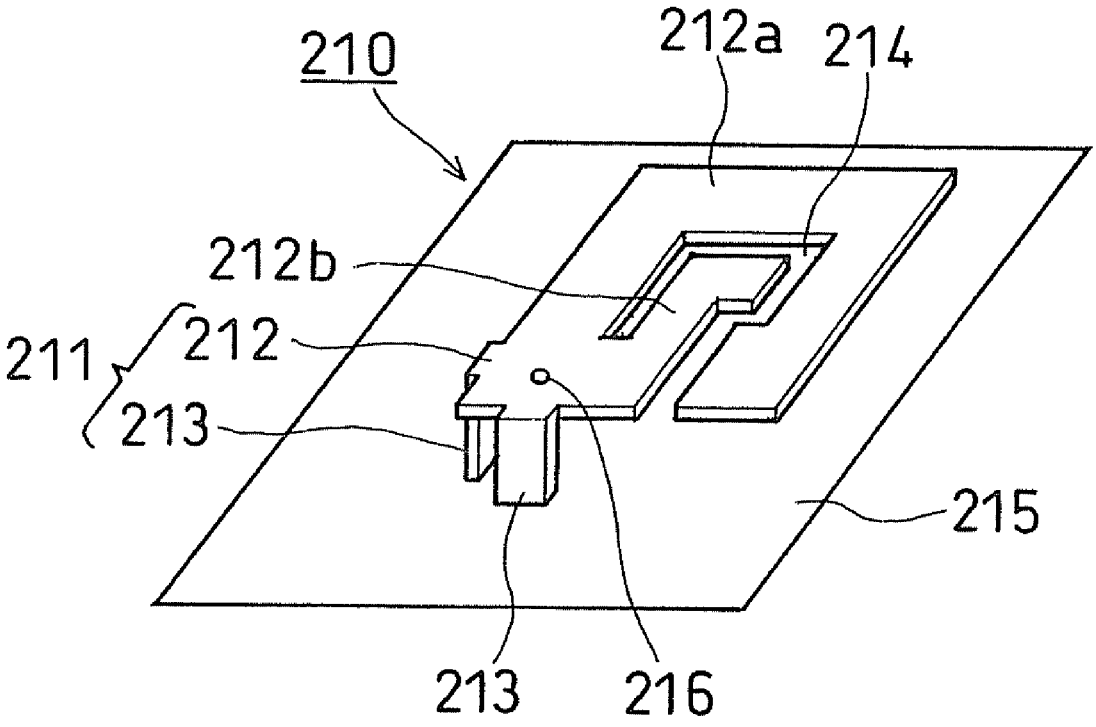
FIG. 15 PRIOR ART
FIG. 15 shows the configuration of a conventional inverted F antenna.

The matching circuit 150 performs impedance matching for the antenna AT, adjusts the impedance of the antenna as shown in FIG. 1, and tunes it to a desired frequency that is used for transmission or reception. According to the antenna provided with the matching circuit according to the present embodiment, by using the antenna apparatus AT that is impedance-matched via connection to the aforementioned matching circuit 150, an antenna having good reflection characteristics in desired frequency bands, such as two frequency bands of the GSM band and the DCS band or three frequency bands further including the PCS band, is provided. In this case, contrary to the configuration of an antenna apparatus where the first conductor strip 212*a* and the second conductor strip 212*b* of the radiation conductor plate 212 and the connection conductor plate 213 are disposed such that they resonate with different frequencies as shown in FIG. 15, the feed portion 5 and the short-circuit portion 7 are disposed such that they resonate with frequencies that are not in a desired frequency band and the adjustment of frequencies is carried out via the matching circuit. Thus, it is advantageous in that influences of circumstances on the antenna characteristics can be reduced. One example of such an advantage is that when a conductor, for example comes close to the periphery of the antenna, the characteristics can be maintained such that they do not differ from those of the conductor in a remote state, so that the antenna characteristics are made less susceptible to influences of a change of circumstances.

Figure 3:
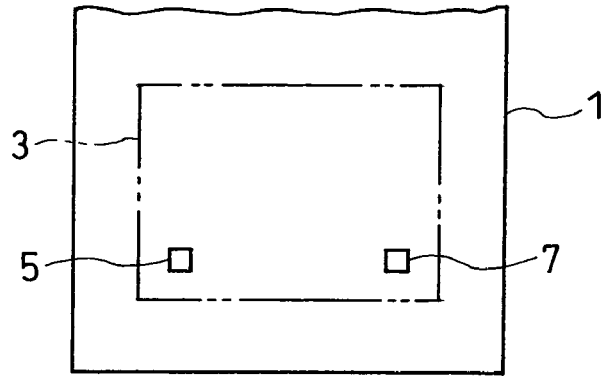
FIG. 3 schematically shows an example of the configuration of an antenna apparatus that is a variation of the antenna apparatus according to the first embodiment.
Figure 3:
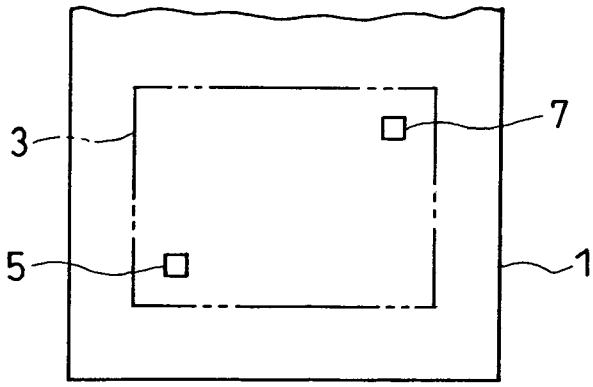

A variation of the antenna apparatus according to the first embodiment of the present invention is described with reference to the drawings. FIG. 3 schematically shows an example of the configuration of the antenna apparatus that is the variation of the present embodiment. FIG. 3(A) shows an example of the configuration of the antenna apparatus according to the present embodiment, indicating the planar positional relationship among the ground conductor 1, the radiation conductor 3, the feed portion 5, and the short-circuit portion 7. A line connecting the feed portion 5 with the short-circuit portion 7 is disposed substantially parallel with one side of the substantially rectangular radiation conductor 3. By contrast, FIG. 3(B) shows an example of the configuration of an antenna apparatus according to the variation of the present embodiment. As can be seen by comparing FIG. 3(A) with FIG. 3(B), they differ in that in FIG. 3(A), the feed portion 5 and the short-circuit portion 7 are disposed such that they are disposed along one side of the rectangle relative to the substantially rectangular radiation conductor 3, while in the antenna apparatus according to the variation, the feed portion 5 and the short-circuit portion 7 are disposed along a diagonal line relative to the substantially rectangular radiation conductor 3. In this manner, the positions of the feed portion 5 and the short-circuit portion 7 can be disposed on the radiation conductor 3 at any position with a distance of d (that has a length not less than ⅙ of the circumference of the radiation conductor 3).

Figure 4:
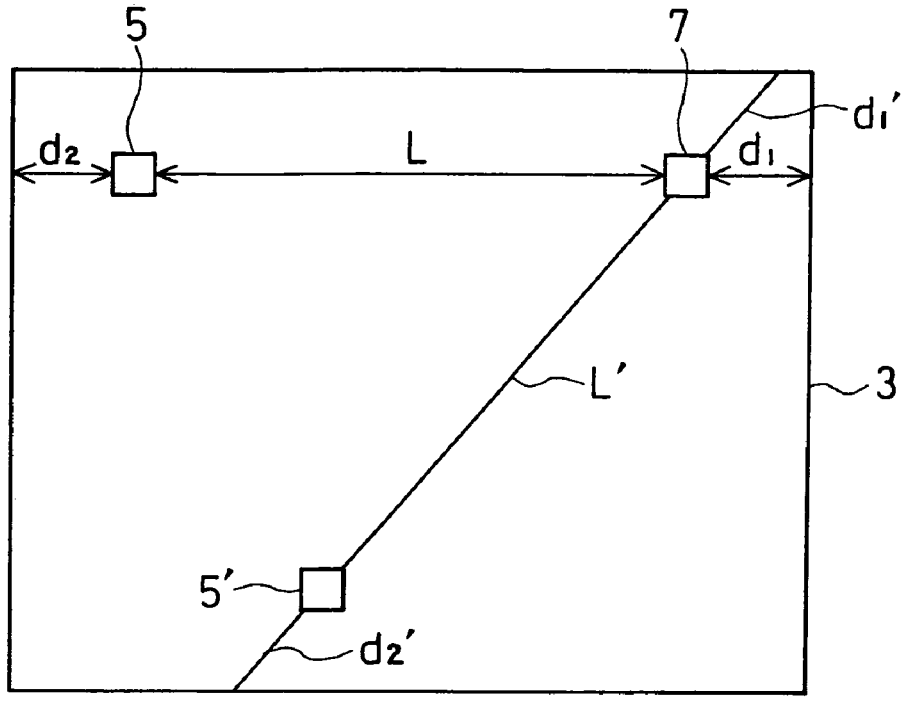
FIG. 4 shows the positional relationships as shown in FIG. 3 in greater detail.

The positional relationship between FIGS. 3(A) and 3(B) are described in detail with reference to FIG. 4. In FIG. 4, in the case where the feed portion 5 and the short-circuit portion 7 are disposed along one side of the rectangle, it is assumed that the distance between the feed portion 5 and the short-circuit portion 7 is L, the distance between the other side of the rectangle extending substantially perpendicularly from an end point of the aforementioned one side of the rectangle and the short-circuit portion 7 is d1, and the distance between one side in the opposite side and the feed portion 5 is d2, for example. When the circumference of the aforementioned radiation conductor 3 is N, L/N>⅙. Meanwhile, in the case of the positional relationship as shown in FIG. 3(B), L'/N>⅙, as well. Further, in the former case, L>d1 and L>d2 are preferred, and in the latter case, L'>d1' and L'>d2' are preferred. In accordance with the aforementioned configuration, antenna characteristics that are less susceptible to influences of usage forms or circumstances can be obtained.

Figure 5:
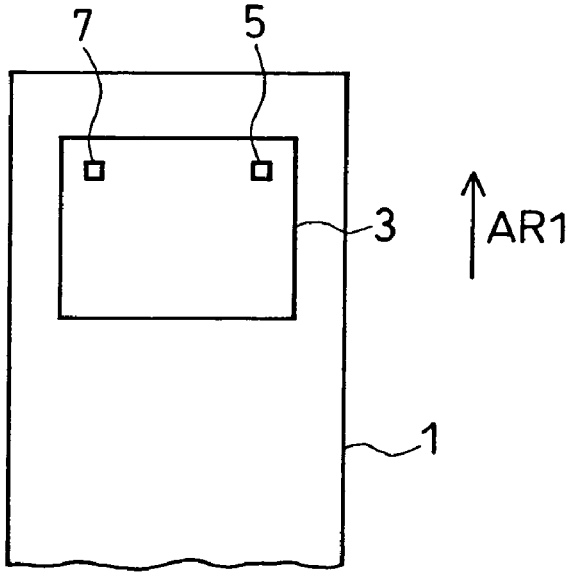
FIG. 5(A) and FIG. 5(B) show an example of the antenna apparatus according to the variation.
Figure 5:
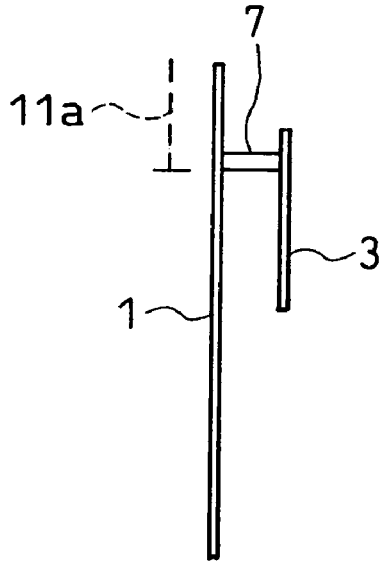

The antenna apparatus according to the variation of the first embodiment of the present invention is described with reference to the drawings. FIG. 5(A) and FIG. 5(B) show an example of the antenna apparatus according to the variation. Basically, the antenna apparatus comprises the same configuration members as those of the first embodiment. However, the antenna apparatus differs in that individual members that constitute the antenna apparatus are disposed in the vicinity of the upper end of a casing that accommodates the antenna apparatus. Although the individual members are disposed in the upper end portion of the casing, conditions described in FIGS. 3 and 4 are applied in the same manner.

As stated above, in the antenna apparatus according to the present embodiment, the same effects as in the first embodiment can be obtained even if the positions of the feed portion or the short-circuit portion in the radiation conductor is changed.

A second embodiment according to the present invention is described with reference to the drawings. The present embodiment is an example where the antenna apparatus according to the first embodiment is applied to a radio communication device. Although radio communication devices include PDAs having communication functions and personal computers, an example where the antenna apparatus is applied to general mobile phones is described.

Figure 6:
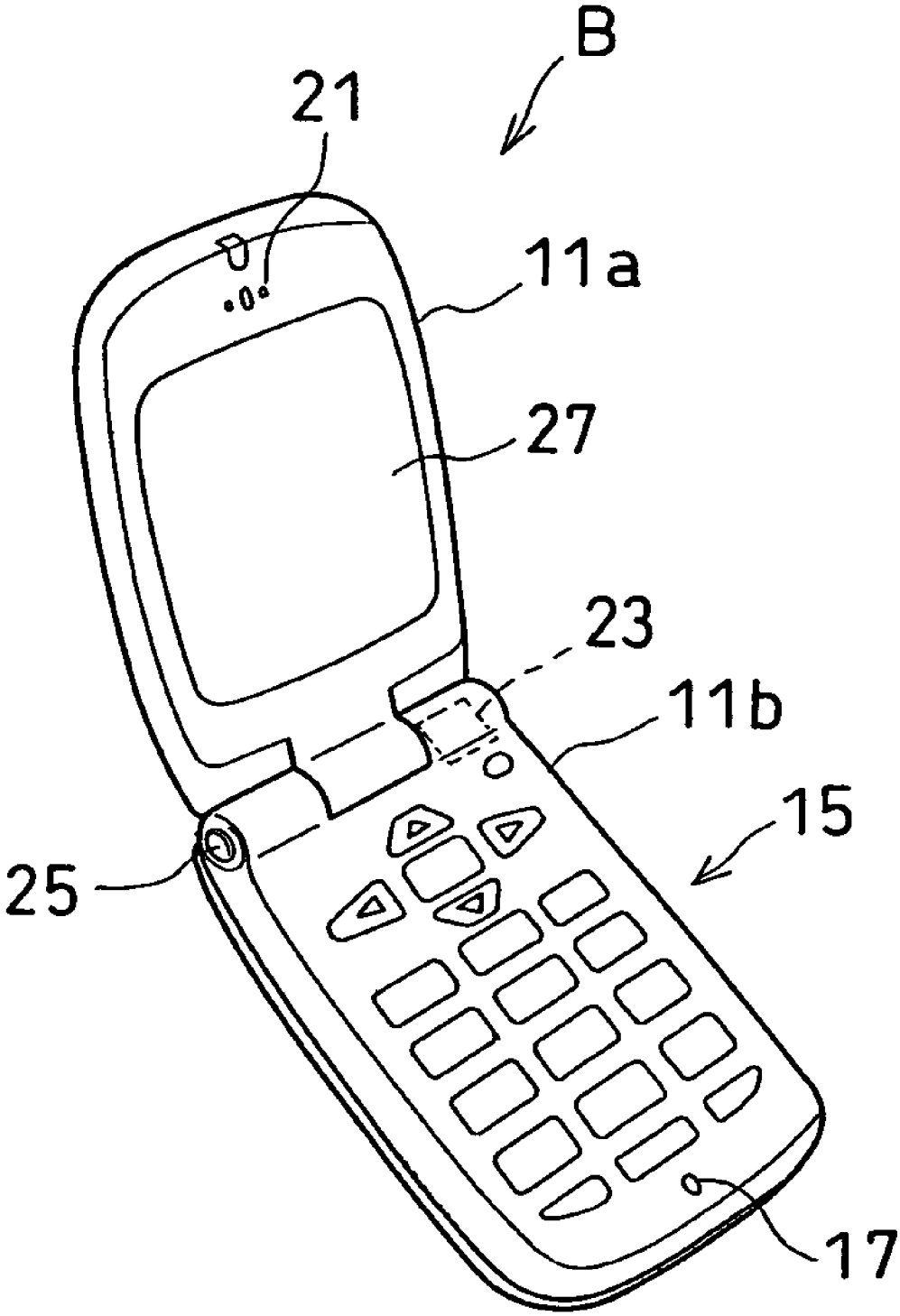
FIG. 6 schematically shows the appearance of a mobile phone according to a second embodiment of the present invention.

FIG. 6 schematically shows the appearance of a mobile phone according to the present embodiment. As shown in FIG. 6, a mobile phone B according to the present embodiment comprises an upper casing 11*a*, a lower casing 11*b*, and a hinge 25 for rotatably connecting these members. The upper casing 11*a* comprises a built-in antenna 23, a speaker 21, and an LCD display screen 27. The lower casing 11*b* comprises a microphone 17 and a button operation portion 15.

Figure 7:
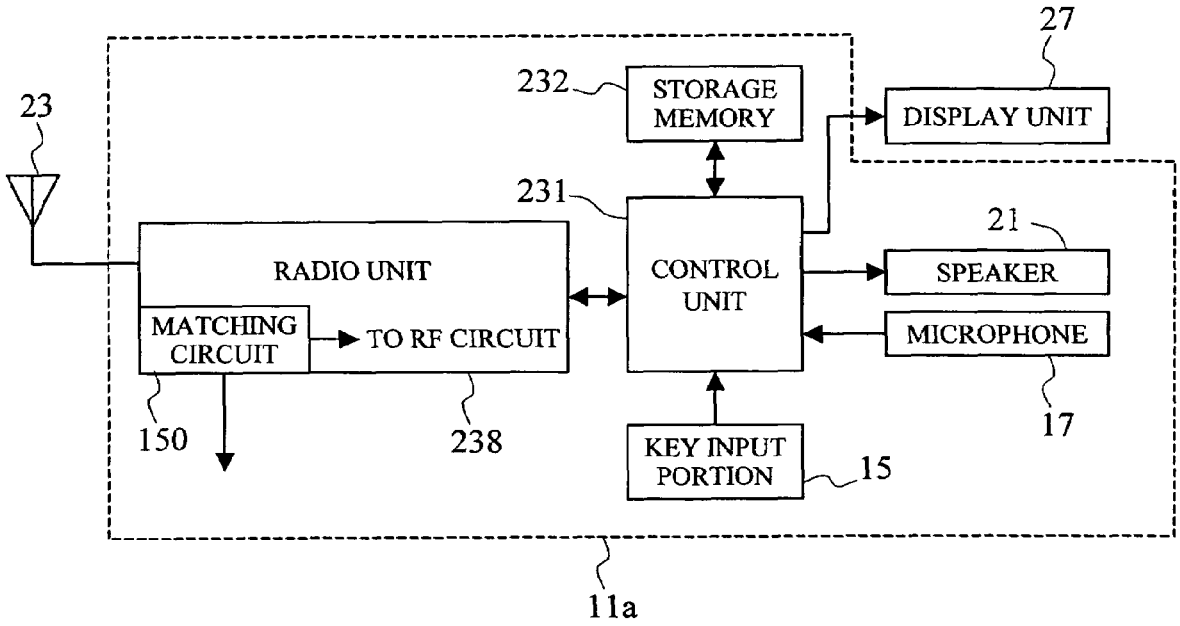
FIG. 7 shows an example of the internal structure of the mobile phone according to the embodiment.

FIG. 7 shows an example of the internal structure of the mobile phone B according to the present embodiment. As shown in FIG. 7, the mobile phone B according to the present embodiment comprises a control unit 231, the antenna 23 (AT), a key input portion (button operation portion) 15, the speaker 21, the LCD display screen (display unit) 27, the microphone 17, a storage memory 232, and a radio unit 238. The control unit 231 unifies and controls the aforementioned individual members. The radio unit 238 comprises the matching circuit 150 as shown in FIG. 2 and the RF circuit connected thereto that is not shown in the drawings. As stated above, by using the antenna apparatus to which the matching circuit 150 disposed for impedance matching is connected, return loss ($R_L$) can be reduced via the matching circuit 150 in two frequency bands, such as in the 800 MHz band and the 1700 to 1900 MHz band, thereby realizing antenna characteristics capable of use in a desired plurality of frequency bands.

Further, when the positional relationship among the ground conductor 1, the radiation conductor 3, and the short-circuit portion 7 of the antenna apparatus as shown in FIG. 5(B) is assumed, it is assumed that a user's face (or head) approaches the LCD display side (denoted by broken line of reference 11*a* in FIG. 5(B)) of the upper casing 1 as during a telephone call. In this case, by disposing the feed portion 5 and the short-circuit portion 7 such that resonant frequency differs due thereto and by adjusting the frequency via the matching circuit 150, antenna characteristics are made less susceptible to influences of circumstances changing in accordance with usage forms. In this respect, the mobile phone B according to the present embodiment is different from a mobile phone having a conventional configuration (FIG. 15) where the first conductor strip 212*a* and the second conductor strip 212*b* of the radiation conductor plate 212 and the connection conductor plate 213 are disposed, so that they resonate with different frequencies.

Figure 8:
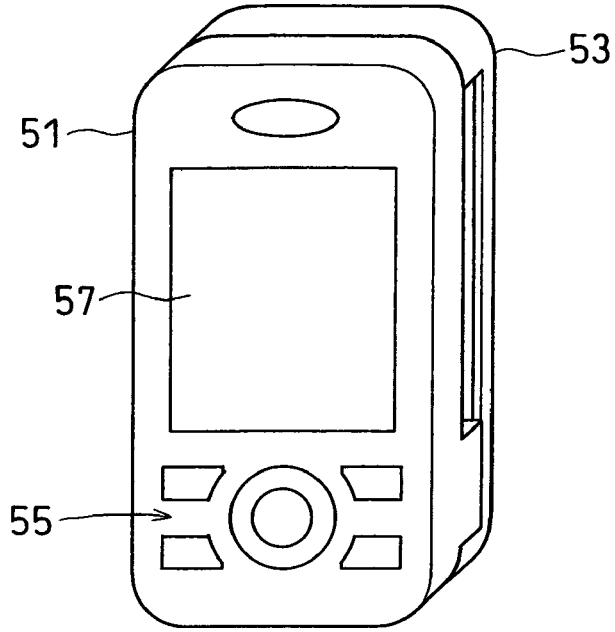
FIG. 8 shows a perspective view (FIG. 8(A)) of a mobile phone according to a third embodiment of the present invention, showing the appearance of the sliding mobile phone when it is closed; a side view (FIG. 8(B)) indicating the corresponding positional relationships of the antenna; and a plan view (FIG. 8(C)) of the antenna apparatus.
Figure 8:
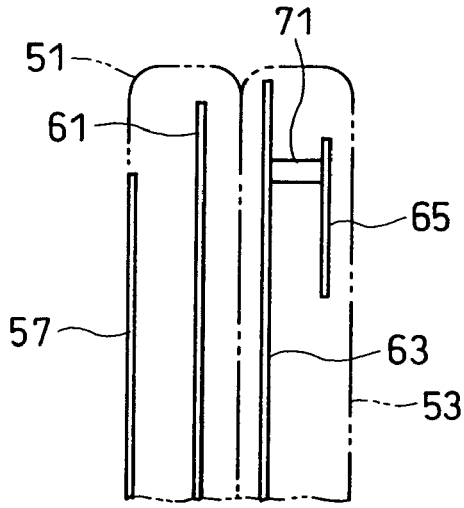
Figure 8:
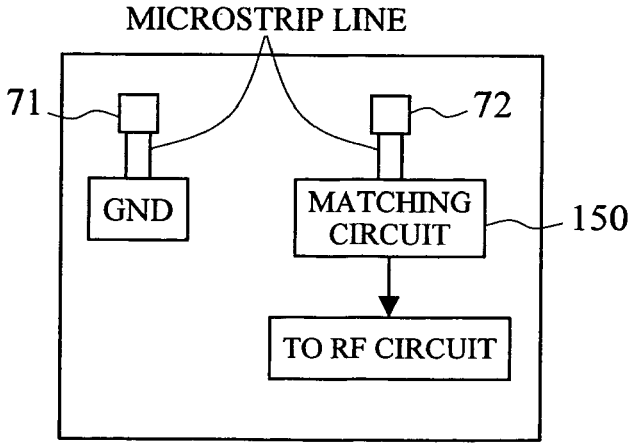
Figure 9:
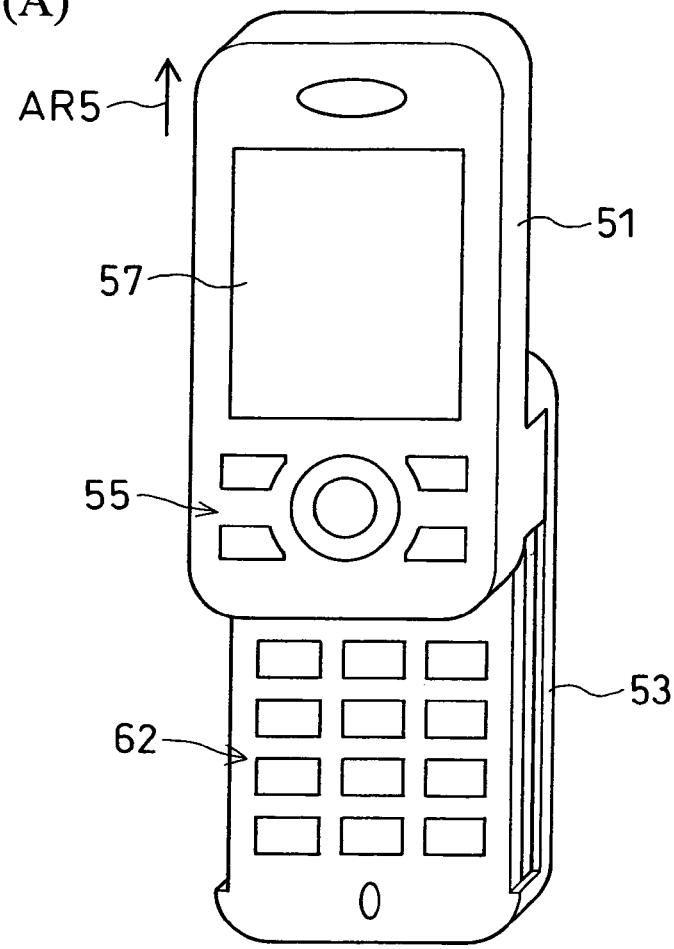
FIG. 9 shows a perspective view (FIG. 9(A)) when the slide mobile phone of FIG. 8 is open, and a side view (FIG. 9(B)) indicating the corresponding positional relationships.
Figure 9:
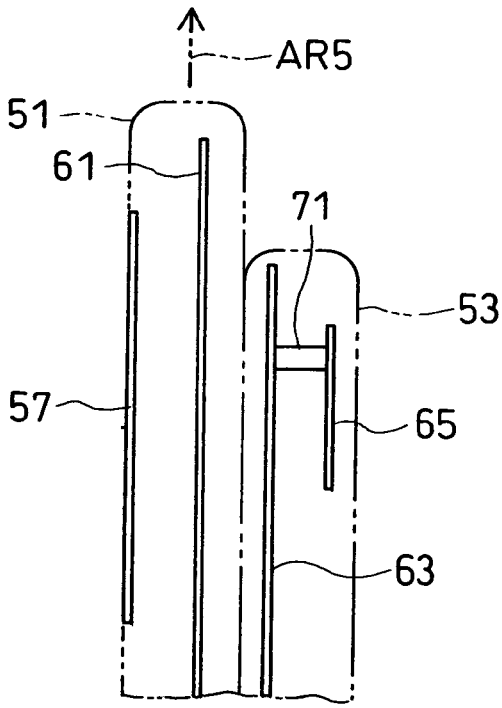

A mobile phone according to a third embodiment of the present invention is described with reference to the drawings. FIGS. 8 and 9 show perspective views (FIGS. 8(A) and 9(A)) of a mobile phone according to the third embodiment of the present invention, showing the appearances of the slide mobile phone when it is open and closed; side views (FIGS. 8(B) and 9(B)) indicating the positional relationships of the antenna corresponding to each perspective view; and a plan view (FIG. 8(C)) of the antenna apparatus. As shown in FIGS. 8(A) and 9(A), the slide mobile phone according to the present embodiment comprises a first casing 51 and a second casing 53. The slide mobile phone comprises an LCD display portion 57 disposed on the first casing 51, a first operation portion (input portion) 55, and a second operation portion 62 disposed on the second casing 53. The first casing 51 and the second casing 53 can be used with a slide as indicated by an arrow shown by reference AR5 (FIG. 9). In the closed state as shown in FIG. 8(A), the first casing 51 and the second casing 53 are in a state where the front and the back thereof are joined together, including during telephone call standby mode or an input operation using the first operation portion 55, for example. In the opened state as shown in FIG. 9(A), the area of contact surface regarding the first casing 51 and the second casing 53 is reduced, and a telephone call is generally made in this state. As shown in FIG. 8(C), a feed portion 72 of a radiation conductor 65 (FIG. 8 (B)) is connected to the RF circuit through a microstrip line and the matching circuit 150, and a short-circuit portion 71 is connected to a ground GND through a microstrip line.

In the closed state as shown in FIG. 8(B), even when the positions of a first circuit board 61 disposed inside the first casing 51 and a radiation conductor 65 are changed as in FIG. 9(B), the radiation conductor 65 being disposed via the short-circuit portion 71 that is disposed on the opposite side of the LCD display portion 57 and that extends from a second circuit board 63 (ground conductor) that is disposed inside the second casing 53 to the back of the normal direction of the display surface of the LCD display portion 57, the short-circuit portion 71 is disposed on the end portion direction of the second circuit board indicated by the arrow AR5 in the second casing 53 and comprises a configuration where frequencies are adjusted via the matching circuit. Thus, in both states as shown in FIG. 8(B) and FIG. 9(B), the reflection characteristics of the antenna apparatus (the radiation conductor 65) are not significantly changed. Also, because the short-circuit portion 71 is disposed in the vicinity of the open-end portion of the ground conductor plate (second circuit board) 63, even if metal exists nearby, for example, the short-circuit portion 71 is less susceptible to the influences thereof. Thus, even in the case where the antenna apparatus is applied to the slide mobile phone according to the present embodiment, the antenna characteristics are not liable to change between standby and telephone calls, providing an advantage that enables stable telephone calls and communication.

Figure 10:
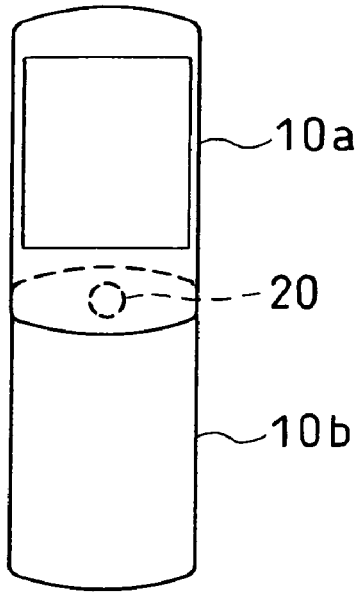
FIG. 10 shows a mobile phone according to the variation of the present invention, illustrating the case where the antenna apparatus according to the first embodiment of the present invention is used for a rotary mobile phone.
Figure 10:
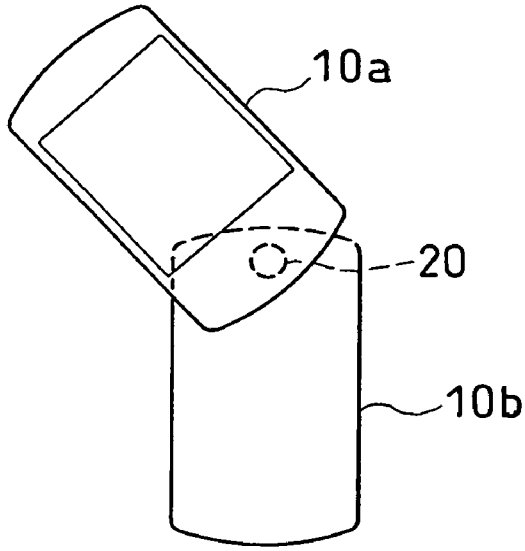
Figure 10:
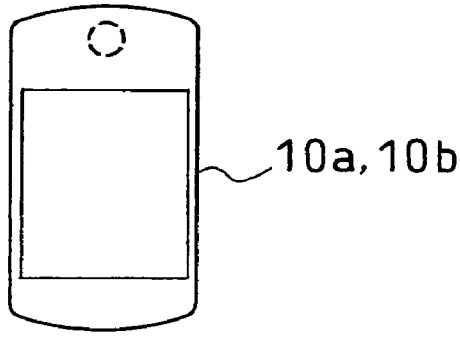

FIG. 10 shows a mobile phone according to the variation of the present invention, illustrating the case where the antenna apparatus according to the first embodiment of the present invention is applied to a rotary mobile phone. FIG. 10(A) shows a mode of use when the device is in operation, indicating the state where a first casing 10*a* and a second casing 10*b* are disposed in a substantially parallel manner having a rotation axis 20 therebetween. FIG. 10(C) shows a mode when standing by, indicating the state where the first casing 10*a* almost covers the second casing 10*b*.

FIG. 10(B) shows a transitional state of rotation. Even in such a case, by disposing the antenna apparatus according to the first embodiment of the present invention inside the first casing 10*a*, the antenna characteristics are made less susceptible to influences of circumstances, so that an advantage is provided by which good antenna characteristics can be obtained in any of the states of FIGS. 10(A) to 10(C).

Figure 11:
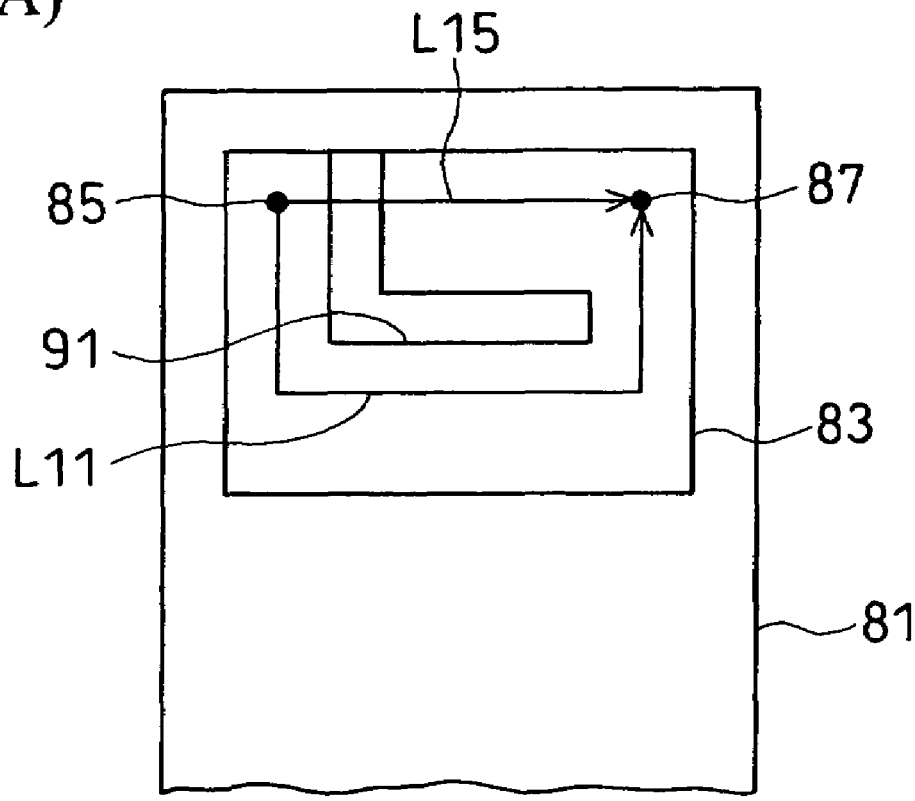
FIGS. 11(A) and 11(B) show examples the configuration of an antenna apparatus according to a fourth embodiment of the present invention, where a notch cutting is provided in a radiation conductor.
Figure 11:
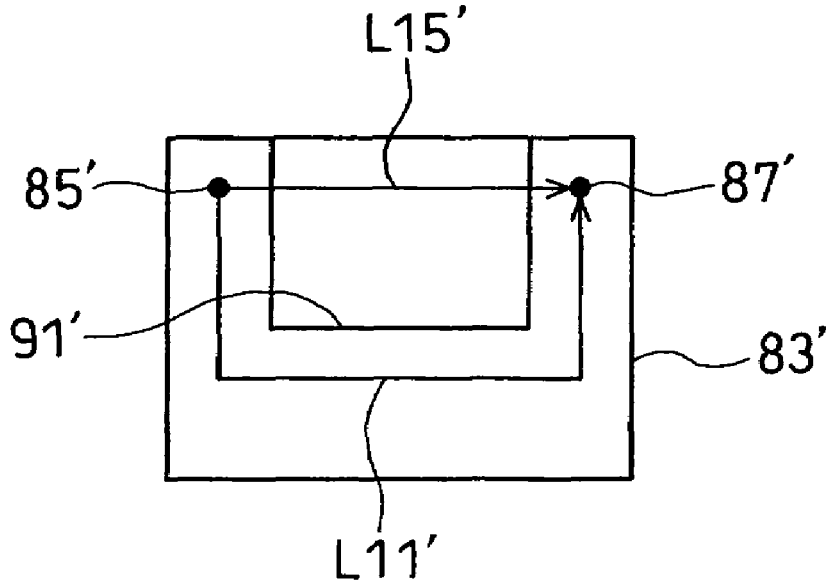

An antenna apparatus according to a fourth embodiment of the present invention is described with reference to the drawings. As shown in FIG. 11(A), in the present embodiment, a notch cutting is provided in the radiation conductor between the feed portion and the short-circuit portion, thereby adjusting the distance between a feed portion 87 and a short-circuit portion 85. The antenna apparatus according to the present embodiment comprising a ground conductor 81 and a radiation conductor 83 has a notch cutting portion 91 formed in an L-shaped manner from the top side of the radiation conductor 83 as shown in the drawings, which is formed in an area including a straight line that connects the feed portion 87 with the short-circuit portion 85. In such a configuration, the electrical length between the feed portion 87 and the short-circuit portion 85 is based on the length of reference L11 circling the notch cutting portion 91 rather than the length of the top side as shown in the drawings (reference L15). Also, in FIG. 11(B), a large notch cutting portion 91' is provided on the top side of a radiation conductor 83'. Also in this configuration, a substantial antenna length is determined on the basis of reference L11' rather than in accordance with a length L15' indicated by reference 91'. In this manner, by providing a notch cutting on an area including a straight line that connects the feed portion 87 with the short-circuit portion 85 in the radiation conductors 83 and 83', adjustment to an effective antenna length can be achieved and the frequency range in which impedance matching can be achieved is widened. This is advantageous in that it effectively works especially when securing antenna characteristics for low frequency bands.

Figure 12:
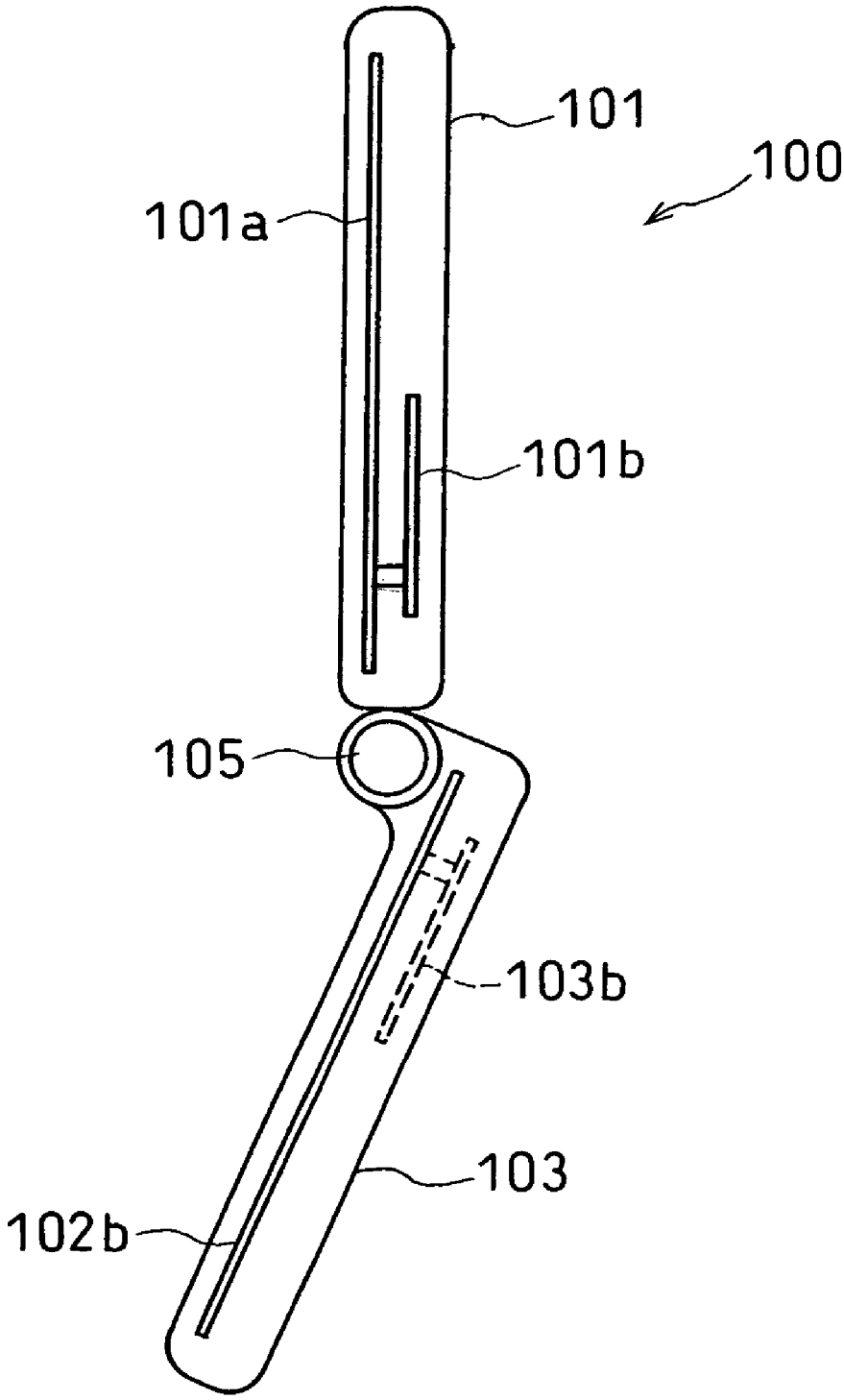
FIG. 12 shows a side view of a mobile phone using an antenna apparatus according to a fifth embodiment of the present invention and also shows the internal configuration thereof.

A mobile phone according to a fifth embodiment of the present invention in which the antenna apparatus according to each of the aforementioned embodiments is used is described. FIG. 12 shows a side view of the mobile phone according to the present embodiment and also shows the internal configuration thereof. As shown in FIG. 12, a mobile phone 100 according to the present embodiment shows an example of the configuration of a folding type mobile phone where a first casing 101 and a second casing 103 are capable of folding such that the LCD display portion and the input operation portion are disposed face-to-face with a rotation axis 105 as an axis. A radiation conductor 101*b* or 103*b* is disposed on either a first circuit board 101*a* or a second circuit board 102*b* disposed on both the first casing 101 and the second casing 103, the radiation conductor extending from the vicinity of one end of the rotation axis 105 to the other end that comes away from the rotation axis 105 (in the drawing, the radiation conductor 101*b* is disposed and the radiation conductor 103*b* is shown with broken lines, as it is not disposed). The circuit board 101*a* and the circuit board 102*b* are connected. In the so-called clamshell type mobile phone as shown in FIG. 12, the difference between the dispositions of the radiation conductor 101*b* and the metal circuit board (ground conductor) 102*b* during folding can be adjusted via the aforementioned matching circuit, so that an advantage is provided by which suitable antenna characteristics can be obtained in any usage form. Further, such characteristics are less susceptible to influences of circumstances, since the short-circuit portion is disposed in the vicinity of the open end portion of either the circuit board 101*a* or the circuit board 102*b* when the radiation conductor is disposed on the position of either 101*b* or 103*b*.

Figure 13:
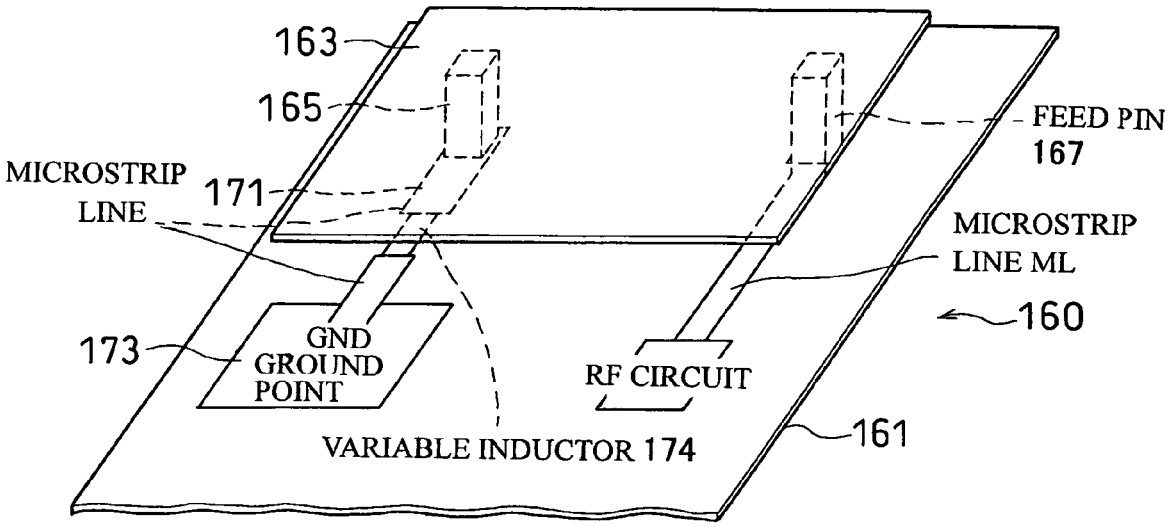
FIG. 13 shows an example of the configuration of an antenna apparatus according to a sixth embodiment of the present invention.

An antenna apparatus according to a sixth embodiment of the present invention is described with reference to the drawings. FIG. 13 shows an example of the configuration of the antenna apparatus according to the present embodiment. As shown in FIG. 13, an antenna apparatus 160 according to the present embodiment comprises a ground conductor 161, a radiation conductor 163, a GND ground point 173 disposed on the ground conductor 161, and a variable inductor 174 for adjusting frequencies disposed between a short-circuit portion 165 that short-circuits the ground conductor 161 and the radiation conductor 163 and the GND ground point 173. An inductance L' between the short-circuit portion 165 and the GND ground point 173 is represented by the following formula.

$$L'=L+\alpha$$

In this case, L represents the inductance between the short-circuit portion 165 and the GND ground point 173 without the variable inductor 174, and $\alpha$ represents the volume of adjustment by variable inductance. Frequencies f' depends on L', namely, L+$\alpha$. Thus, an advantage is provided by which frequency adjustment becomes possible via the volume of $\alpha$.

Figure 14:
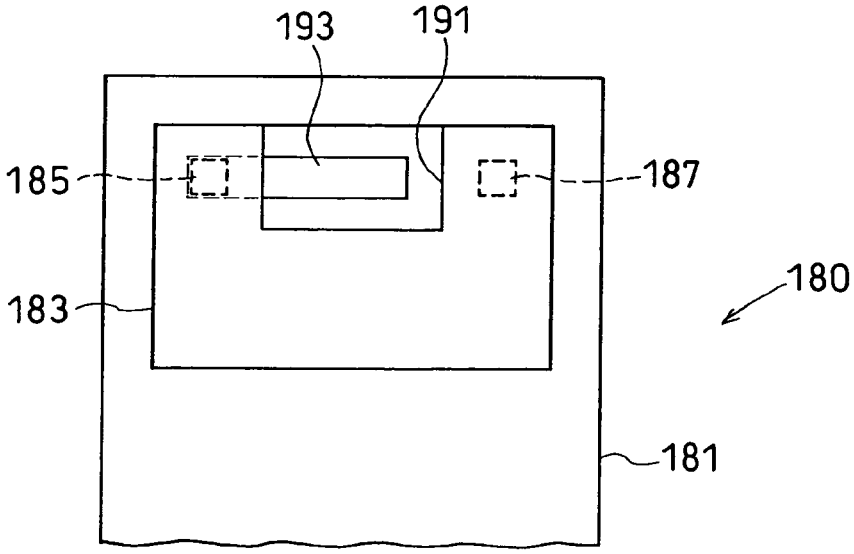
FIG. 14 shows a main portion of an antenna apparatus according to a seventh embodiment of the present embodiment.

An antenna apparatus according to a seventh embodiment of the present invention is described with reference to the drawings. FIG. 14 shows a main portion of the antenna apparatus according to the present embodiment of the present invention. As shown in FIG. 14, an antenna apparatus 180 according to the present embodiment of the present invention comprises a ground conductor 181, a radiation conductor 183, and a parasitic element 193 extending from a short-circuit portion 185 to the internal area of a notch cutting 191 provided in the radiation conductor 183. By disposing the parasitic element 193 in this manner, an advantage is provided by which the band of the antenna is widened. By appropriately adjusting the length of the parasitic element 193 to about $\lambda/4$ of a desired frequency, for example, antenna characteristics can be improved.

As stated above, the embodiments of the present invention are described with reference to the drawings. However, the present invention is not limited to these embodiments, and it is obvious that various modifications are possible.

The present invention can be applied to various antenna apparatuses and a communication apparatus using an antenna apparatus. For example, the present invention also improves antenna characteristics when used for straight type mobile phones, and the antenna can be applied to both slide types and folding types.

What is claimed is:

1. A wireless equipment, comprising:

an antenna, the antenna comprising:

a ground conductor plate, a radiation conductor plate disposed at a certain distance from the ground conductor plate and facing the same, a short-circuit portion for connecting the radiation conductor plate and the ground conductor plate, and a feed portion for exciting the radiation conductor plate, wherein the short-circuit portion and the feed portion are disposed such that the antenna resonates at a frequency that is not in a frequency band;

a matching circuit for adjusting an impedance of the antenna, the matching circuit being connected to the feed portion; and a controller controlling the matching circuit so that the antenna resonates at the frequency that is not in the frequency band, and controlling the matching circuit so that adjustments of the frequency of the antenna into the frequency band is carried out through impedance matching via the matching circuit.

2. The wireless equipment according to claim 1, wherein a plurality of frequencies are used for communication.

3. The wireless equipment according to claim 1, wherein a notch cutting is provided in the radiation conductor between the feed portion and the short-circuit portion.

4. The wireless equipment according to claim 1, wherein a variable inductor for varying inductance is disposed between the short-circuit portion and a grounded portion disposed on the ground conductor plate.

5. The wireless equipment according to claim 1, wherein a parasitic element that is connected to the short-circuit portion is disposed between the feed portion and the short-circuit portion.

6. The wireless equipment according to claim 1, wherein the short-circuit portion is disposed in the vicinity of an end portion of the ground conductor plate.

7. The wireless equipment according to claim 1, wherein the ground conductor plate defines a hole, and the feed portion extends through the hole without making contact with the ground conductor plate.

8. The wireless equipment according to claim 1, wherein the short-circuit portion and the feed portion are disposed such that the antenna resonates with a frequency that is not in any frequency band.

9. The wireless equipment according to claim 1, wherein the controller controls the matching circuit so that the antenna resonates at the frequency that is not in the frequency band that is used for transmission or reception, and controls the matching circuit so that adjustments of the frequency of the antenna into the frequency band that is used for transmission or reception is carried out through impedance matching via the matching circuit.

10. The wireless equipment according to claim 1, wherein the controller controls the matching circuit so that the antenna resonates at the frequency that is not in the frequency band that is used for transmission, and controls the matching circuit so that adjustments of the frequency of the antenna into the frequency band that is used for transmission is carried out through impedance matching via the matching circuit.

11. The wireless equipment according to claim 1, wherein the controller controls the matching circuit so that the antenna resonates at the frequency that is not in the frequency band that is used for reception, and controls the matching circuit so that adjustments of the frequency of the antenna into the frequency band that is used for reception is carried out through impedance matching via the matching circuit.

12. The wireless equipment according to claim 1, wherein the controller controls the matching circuit so that the antenna resonates at the frequency that is not in the frequency band that is used for transmission or reception by the antenna, and controls the matching circuit so that adjustments of the frequency of the antenna into the frequency band that is used for transmission or reception by the antenna is carried out through impedance matching via the matching circuit.

13. The wireless equipment according to claim 1, wherein the controller controls the matching circuit so that the antenna resonates at the frequency that is not in the frequency band that is used for transmission by the antenna, and controls the matching circuit so that adjustments of the frequency of the antenna into the frequency band that is used for transmission by the antenna is carried out through impedance matching via the matching circuit.

14. The wireless equipment according to claim 1, wherein the controller controls the matching circuit so that the antenna resonates at the frequency that is not in the frequency band that is used for reception by the antenna, and controls the matching circuit so that adjustments of the frequency of the antenna into the frequency band that is used for reception by the antenna is carried out through impedance matching via the matching circuit.

15. The wireless equipment according to claim 1, wherein the wireless equipment is a communication device and the frequency band is a communication frequency band.

16. A wireless equipment, comprising:

an antenna, the antenna comprising:

a ground conductor plate, a radiation conductor plate disposed at a certain distance from the ground conductor plate and facing the same, a short-circuit portion for connecting the radiation conductor plate and the ground conductor plate, and a feed portion for exciting the radiation conductor plate, wherein the short-circuit portion and the feed portion are disposed such that the radiation conductor plate resonates at a frequency that is outside of a frequency band;

a matching circuit for adjusting an impedance of the antenna, the matching circuit being connected to the feed portion; and a controller controlling the matching circuit so that the radiation conductor plate resonates at the frequency that is outside of the frequency band without the matching circuit, and controlling the matching circuit so that adjustments of the frequency from outside of the frequency band into the frequency band is carried out through impedance matching via the matching circuit.

17. The wireless equipment according to claim 16, wherein the matching circuit can also adjust the frequency into another frequency band.

18. The wireless equipment according to claim 16, wherein the short-circuit portion and the feed portion are disposed such that the radiation conductor plate resonates with a frequency that is not in any frequency band without the matching circuit.

19. The wireless equipment according to claim 16, wherein the matching circuit can also adjust the frequency into another frequency band, and wherein the short-circuit portion and the feed portion are disposed such that the radiation conductor plate resonates with a frequency that is not in any frequency band without the matching circuit.

20. A wireless equipment, comprising:

an antenna that can resonates at a plurality of frequency bands that are used for transmission or reception by the wireless equipment;

a matching circuit for adjusting an impedance of the antenna; and a controller controlling the matching circuit so that the antenna resonates at a frequency that is distinct from the plurality of frequency bands without the matching circuit and controlling the matching circuit so that the frequency of the antenna is adjusted into one of the plurality of frequency bands through impedance matching by the matching circuit, wherein the frequency that is distinct from the plurality of frequency bands is not used for transmission or reception by the wireless equipment.

* * * * *